US007848695B2

(12) United States Patent
Bateman, III

(10) Patent No.: US 7,848,695 B2
(45) Date of Patent: Dec. 7, 2010

(54) TONER BRUSH WITH SUPERIMPOSED BRUSHES FOR AN ELECTRO-PHOTOGRAPHIC PRINTER AND PRINTER WITH THE TONER BRUSH

(75) Inventor: William Ashmead Courtenay Bateman, III, Longmont, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 221 days.

(21) Appl. No.: 12/107,915

(22) Filed: Apr. 23, 2008

(65) Prior Publication Data

US 2009/0269110 A1 Oct. 29, 2009

(51) Int. Cl.
*G03G 21/00* (2006.01)

(52) U.S. Cl. ..... 399/353

(58) Field of Classification Search ..... 399/343, 399/345, 347, 349, 353
See application file for complete search history.

(56) References Cited

U.S. PATENT DOCUMENTS 3,816,799 A 6/1974 Ott et al.
3,989,372 A 11/1976 Davidge et al.
4,361,922 A 12/1982 Karal
4,381,325 A 4/1983 Masuda et al.
4,407,219 A 10/1983 Dellevoet
5,128,725 A 7/1992 Frankel et al.
5,216,467 A 6/1993 Esser et al.
5,652,945 A 7/1997 Thayer et al.
5,923,940 A 7/1999 Baldwin et al.
7,319,841 B2 1/2008 Bateman, III et al.
7,343,133 B2 * 3/2008 Ueno ..... 399/353

FOREIGN PATENT DOCUMENTS

JP 58023076 A2 2/1983

* cited by examiner

*Primary Examiner*—Hoang Ngo
(74) *Attorney, Agent, or Firm*—Law Office of Charles W. Peterson, Jr.; Dale M. Crockatt

(57) ABSTRACT

A toner brush for a printer and a printer including the toner brush. The toner brush includes a substrate (e.g. a core cylinder) with a cleaning brush and a residual toner brush superimposed over one another. During printing the printer holds the residual toner brush against a photoconductor or photoconductive surface, e.g., a photoconductive drum. For deep cleaning, the printer moves the cleaning brush closer to the photoconductor surface and holds it against the surface during deep cleaning. Deep cleaning may be automatically or manually (e.g., by an operator) initiated.

20 Claims, 2 Drawing Sheets

TONER BRUSH WITH SUPERIMPOSED BRUSHES FOR AN ELECTRO-PHOTOGRAPHIC PRINTER AND PRINTER WITH THE TONER BRUSH

BACKGROUND OF THE INVENTION

The present invention generally relates to electro-photographic printers and more particularly to maintenance of high performance electro-photographic printers and increasing electro-photographic printer utilization.

BACKGROUND DESCRIPTION

Purchasing a state of the art high performance electro-photographic printer may require a major investment from a business concern. To recoup that investment, the business concern may keep the electro-photographic printer running 24 hours a day, seven days a week. So, any time that the electro-photographic printer is not operating, the owner is losing money.

During printing, the surface of a photoconductor, e.g., a photoconductive drum, receives an electrostatic charge as it moves past a charging station. Then, the charged surface passes an exposure station that exposes an illuminated image on the moving surface, e.g., with a modulated laser beam directed to a rotating mirror to repeatedly sweep the laser across the surface. The modulated laser striking the surface at least partially discharges local surface areas, forming a latent image of charged and discharged areas. As the surface moves past a developing station, the developing station deposits toner that adheres, e.g., electrostatically to the charged areas, but not to discharged areas or vice versa. This forms a toned image on the surface. As the toned surface contacts a recording medium, e.g., paper in a transfer station, typically in the presence of an electric field between the photoconductor and the medium, toner from the toned image transfers to the recording medium.

Generally, some residual of the toner particles do not transfer to the medium, and toner residue remains on the surface. So typically, the surface passes by a cleaning station to remove residual toner before the surface passes the charging station again. Electro-photographic printers frequently use a rotating brush, such as a fur brush, in the cleaning station that engages the surface to facilitate removing this residual toner. Unfortunately, such a brush fails to remove all residual toner. Some toner particles may agglomerate into larger particles or into a toner film that collect on the photoconductor. The rotating brush may not readily remove either of these. Typically removal requires an operator or customer service representative to take the printer system down and hand clean the photoconductor with rags and chemicals. This downtime costs the owner from loss of productivity and also for customer service representative time.

Consequently, electrophotographic printers may employ a scraper blade held against the moving surface in addition to or instead of a brush. A typical scraper blade is a soft plastic or elastomeric material edge pressed against the photoconductor surface. The blade may cause wear and tear to the surface, scratching the surface. Further, residual toner may attach to the scraper blade surface itself, which impairs scraper bladed efficiency. Also contact stresses during the scraping process can cause the scraper blade may to wear unevenly. The uneven wear produces an uneven contact line making the scraper blade ineffective (e.g., causing streaking like old windshield wipers) and causing uneven photoconductor wear.

U.S. Pat. No. 7,319,841 to Bateman III, et al. entitled "Apparatus and Method for Cleaning Residual Toner with a Scraper Blade Periodically Held in Contact with a Toner Transfer Surface," assigned to the assignee of the present invention and incorporated herein by reference, shows an improvement on the typical printer scraper blade. The Bateman III, et al. blade is attached to a brush housing and held away from the photoconductor during normal printing operation. Periodically, the Bateman III, et al. brush housing rotates to contact the scraper blade to the photoconductor surface. While photoconductor and blade wear and tear are dramatically reduced by Bateman III, et al., even intermittent use causes some scratching and wear, reducing the life of both the photoconductor and the blade. Replacing either also carries printer downtime costs.

Thus, there is a need for maintaining in state of the art high performance printers and especially, for maintaining the surface of a photoconductor free from residual toner.

SUMMARY OF THE INVENTION

It is therefore a purpose of the invention to reduce high performance printer down time;

It is another purpose of this invention to improve electro-photographic printer reliability;

It is yet another purpose of the invention to reduce electro-photographic printer operating and maintenance costs.

The present invention is related to a toner brush for a printer and a printer including the toner brush. The toner brush includes a substrate (e.g. a core cylinder) with a cleaning brush and a residual toner brush superimposed over one another. During printing the printer holds the residual toner brush against a photoconductor or photoconductive surface, e.g., a photoconductive drum. For deep cleaning, the printer moves the cleaning brush to the photoconductive surface and holds it against the surface during deep cleaning. Deep cleaning may be automatically or manually (e.g., by an operator) initiated.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF PREFERRED EMBODIMENTS

Figure 1:
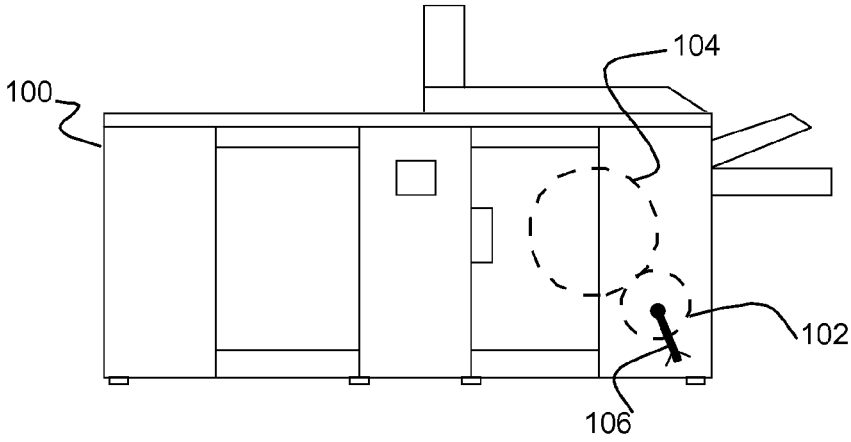
FIG. 1 shows an example of an electro-photographic printer with a multi-positioned toner brush 102, according to a preferred embodiment of the present invention.

Turning now to the drawings, and more particularly, FIG. 1 shows an example of an electro-photographic printer 100 with a multi-positioned toner brush 102, according to a preferred embodiment of the present invention. The toner brush 102 is located at a photoconductor 104 or photoconductive surface, e.g., a typical photoconductive drum. Preferably, the toner brush 102 is a residual toner brush and a deep cleaning brush, with one brush superimposed on the other and positioned at the photoconductor 104, e.g., with a reciprocating actuator 106, for example. In its normal operating position the actuator 106 holds the residual toner brush against the photoconductor 104 to sweep away residual toner. In a deep cleaning position the actuator 106 holds the deep cleaning brush closer to the photoconductor 104 to remove toner deposits and agglomerate. It is understood that sizes and locations of elements and features described herein are not to scale and provided for example only unless specifically indicated otherwise.

Preferably, the toner brush 102 includes interleaved bristles in two groups, bristles in each group having a common nominal length and tensile strength or stiffness. In one group, the bristles are long and soft and in the other, the bristles are shorter and stiffer. Thus, as provided in more detail hereinbelow, in a first, normal operating position the toner brush 102 uses the group of longer, softer bristles to remove residual toner that remains on the photoconductor 104 after each printing. Periodically, the toner brush 102 moves to a second position to place short deep cleaning bristles in the other group in contact with the photoconductor 104 to remove toner deposits and agglomerate in a deep cleaning cycle. Since the preferred toner brush 102 removes virtually all toner in the deep cleaning cycles, down-time from manual cleaning is dramatically reduced or eliminated. Further, the deep cleaning bristles cause very little, if any, photoconductor surface damage or scratching, which reduces the cost incurred in replacing the photoconductors 104.

Figure 2A:
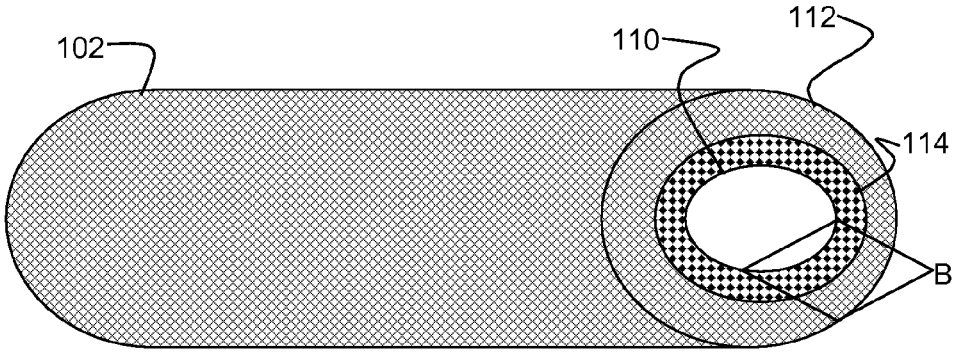
FIGS. 2A-B show an example of a preferred toner brush.
Figure 2B:
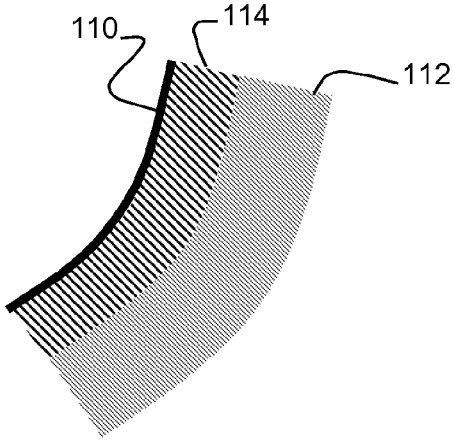

FIG. 2A shows an example of a preferred toner brush 102 in more detail and FIG. 2B shows a blow up example of section B in yet more detail. As can be seen from this example, a preferred toner brush 102 interleaves bristles attached (e.g., glued) to a substrate, e.g., a core cylinder 110 or spindle, and that terminate in two levels 112, 114. Longer bristles that terminate at the outer level 112 are used, primarily after each printing in the first, normal operating position to remove residual toner that remains on the photoconductor 104. Shorter, stiffer bristles that terminate at the inner level 114 are used, primarily, in the deep cleaning cycles. It should be noted that although described herein as bristles being dispersed uniformly or homogeneously over core cylinder 110, this is for example only and not intended as a limitation. Interleaving may include any suitable superimposition of two different bristles, such as, for example, alternate rows of short and long bristles.

The core cylinder 110 may be any suitable material such as paper/cardboard, plastic or poly(tetrafluoroethylene) (PTFE). The longer bristles are, preferably, of a suitable soft non-absorbative natural (e.g., fur or hair) or man-made material (e.g., rayon, nylon, or a polyester polymer) for sweeping toner away. Preferably also, the shorter bristles are of a suitable non-absorbative natural (e.g., hog/boar bristle) or man-made non-conductive material (e.g., thicker rayon, nylon, or a rayon/nylon/polyester polymer or a polyester polymer) that is stiff enough to remove residual toner, wax, silica, and paper by-products or anything else that may collect on the photoconductor 104. Further, these shorter bristles may be embedded with an abrasive material, e.g., silica, tungsten oxide, tungsten carbide, silicon carbide, or walnut shells. Preferably, the bristles are chosen such that the stiffer short bristles have a minimum flex (e.g., at ½ inch or 1.25 cm) and the softer long bristles sweep the toner from the photoconductor 104 without the shorter bristles contacting the surface of photoconductor 104.

Figure 3A:
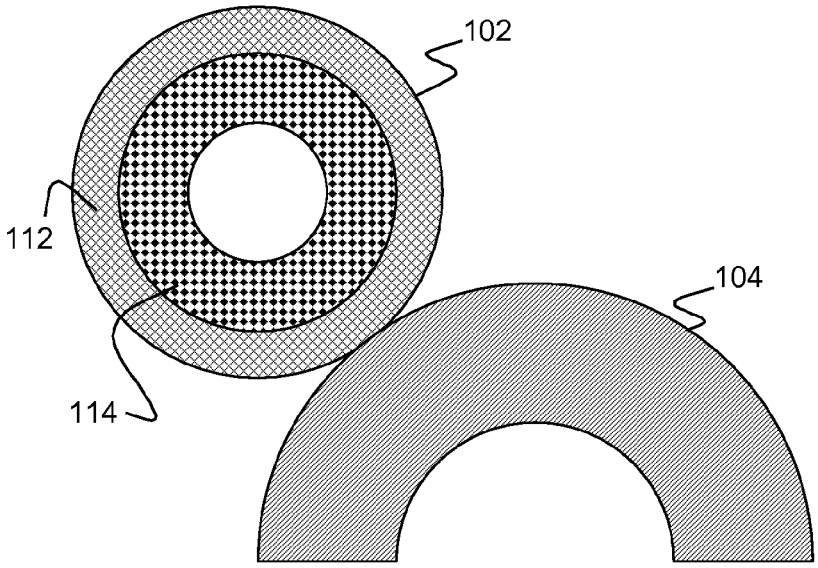
FIGS. 3A-B show examples of the preferred toner brush normally positioned and deep cleaning the photoconductor.
Figure 3B:
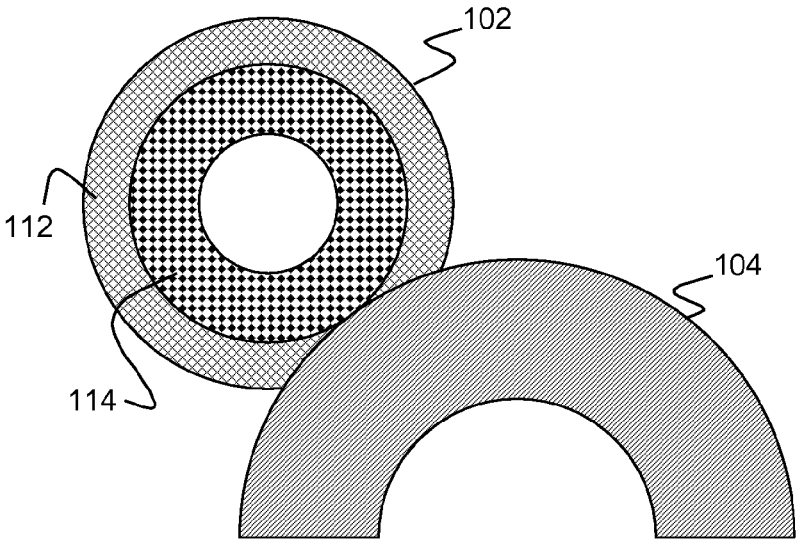

FIGS. 3A-B show examples of the preferred toner brush 102 normally positioned and positioned for deep cleaning the photoconductor 104. So, as can be seen from FIG. 3A with the preferred toner brush 102 at its normal operating position, the softer, longer bristles contact the photoconductor 104 at the outer level 112. The softer, bristles sweep toner normally, removing toner from the photoconductor 104 between printing to medium. Periodically, as shown in FIG. 3B, the preferred toner brush 102 shifts position such that the stiffer shorter, bristles contact the photoconductor 104 at the inner level 114. Deep cleaning may be initiated manually, e.g., by an operator, or scheduled for automatic initiation.

Advantageously, the preferred toner brush removes virtually all toner in the deep cleaning cycles, customer service representative time and printer down-time from manual cleaning is dramatically reduced or eliminated. Further, the deep cleaning bristles cause very little, if any, photoconductor surface damage or scratching, which reduces the cost incurred in replacing the photoconductors.

While the invention has been described in terms of preferred embodiments, those skilled in the art will recognize that the invention can be practiced with modification within the spirit and scope of the appended claims. It is intended that all such variations and modifications fall within the scope of the appended claims. Examples and drawings are, accordingly, to be regarded as illustrative rather than restrictive.

I claim:

1. A toner brush comprising:

a substrate;

a cleaning brush attached to said substrate and having a first height relative to said substrate; and a residual toner brush attached to said substrate and having a second height relative to said substrate, said second height being greater than said first height, wherein said cleaning brush and said residual toner brush are superimposed one over the other.

2. A toner brush as in claim 1, wherein said substrate is a core cylinder and bristles of said cleaning brush are interleaved with bristles of said residual toner brush.

3. A toner brush as in claim 2, wherein bristles of said cleaning brush are shorter than bristles of said residual toner brush, such that said residual toner brush may be located adjacent to a surface, while said cleaning brush remains spaced away from said surface.

4. A toner brush as in claim 2, wherein uniformly dispersed rows of said bristles of said cleaning brush are interleaved with uniformly dispersed rows of said bristles of said residual toner brush.

5. A toner brush comprising:

a core cylinder;

a plurality of first bristles having a first nominal length and first stiffness, said plurality of first bristles being attached to said core cylinder, uniformly dispersed and extending radially outward from said core cylinder; and a plurality of second bristles having a second nominal length and second stiffness, said plurality of second bristles being attached to said core cylinder, uniformly dispersed interleaved with said plurality of first bristles and extending radially outward from said core cylinder, said second nominal length being shorter than said first nominal length and said second stiffness being stiffer than said first stiffness.

6. A toner brush as in claim 5, wherein said plurality of second bristles are non-conductive bristles.

7. A toner brush as in claim 6, wherein said plurality of first bristles are non-conductive bristles.

8. A printer comprising:

a photoconductive surface, toned images forming on said photoconductive surface, formed toned images transferring to print medium during printing;

a toner brush adjacent to and in contact with said photoconductive surface, said toner brush comprising:

a substrate, a cleaning brush attached to said substrate and having a first height relative to said substrate, and a residual toner brush attached to said substrate and having a second height relative to said substrate, said second height being greater than said first height, wherein said cleaning brush and said residual toner brush are superimposed one over the other and said residual toner brush is held in contact with said photoconductive surface during printing; and an actuator attached to said toner brush and holding said toner brush in place, said actuator selectively moving said toner brush to contact said cleaning brush with said photoconductive surface.

9. A printer as in claim 8, wherein bristles of said cleaning brush are shorter than and uniformly dispersed interleaved with bristles of said residual toner brush.

10. A printer as in claim 9, wherein said substrate is a core cylinder and said bristles of said residual toner brush have a first nominal length and first stiffness and are attached to said core cylinder and extend radially outward from said core cylinder.

11. A printer as in claim 10, wherein said bristles of said cleaning brush have a second nominal length shorter than said first nominal length and a second stiffness stiffer than said first stiffness and said bristles of said cleaning brush are attached to said core cylinder and extend radially outward from said core cylinder.

12. A printer as in claim 9, wherein said photoconductive surface is a photoconductive drum and uniformly dispersed rows of said bristles of said cleaning brush are interleaved with uniformly dispersed rows of said bristles of said residual toner brush.

13. A printer as in claim 8 automatically initiating deep cleaning periods, during each said deep cleaning period, said actuator in said printer moves said toner brush to contact said cleaning brush with said photoconductive surface.

14. A printer as in claim 8 initiating deep cleaning periods responsive to manual selection, during each said deep cleaning period, said actuator in said printer moves said toner brush to contact said cleaning brush with said photoconductive surface.

15. A printer comprising:

a photoconductor, toned images forming on said photoconductor, formed toned images transferring to print medium during printing;

a toner brush adjacent to and in contact with said photoconductor, said toner brush comprising:

a core cylinder, a cleaning brush attached to said core cylinder and having a first height relative to said core cylinder, and a residual toner brush attached to said core cylinder and having a second height relative to said core cylinder, said second height being greater than said first height, wherein said cleaning brush and said residual toner brush are superimposed one over the other and said residual toner brush is held in contact with said photoconductor during printing; and an actuator attached to said toner brush and holding said toner brush in place, said actuator selectively moving said toner brush to contact said cleaning brush with said photoconductor during automatically initiated deep cleaning periods.

16. A printer as in claim 15, wherein bristles of said cleaning brush are shorter than and uniformly dispersed interleaved with bristles of said residual toner brush.

17. A printer as in claim 16, wherein said bristles of said residual toner brush have a first nominal length and first stiffness and are attached to said core cylinder and extend radially outward from said core cylinder.

18. A printer as in claim 17, wherein said bristles of said cleaning brush have a second nominal length shorter than said first nominal length and a second stiffness stiffer than said first stiffness and said bristles of said cleaning brush are attached to said core cylinder and extend radially outward from said core cylinder.

19. A printer as in claim 16, wherein uniformly dispersed rows of said bristles of said cleaning brush are interleaved with uniformly dispersed rows of said bristles of said residual toner brush.

20. A printer as in claim 15 said deep cleaning periods further being initiated responsive to manual selection.

* * * * *